US011260522B2

(12) United States Patent
Monahan et al.

(10) Patent No.: US 11,260,522 B2
(45) Date of Patent: Mar. 1, 2022

(54) MULTI-SECTION QUICK ASSEMBLY HANDLE AND METHOD OF MAKING SAME

(71) Applicants: Patrick H. Monahan, Arcola, IL (US); Kurt Ni, Taipei (TW)

(72) Inventors: Patrick H. Monahan, Arcola, IL (US); Kurt Ni, Taipei (TW)

( * ) Notice: Subject to any disclaimer, the term of this patent is extended or adjusted under 35 U.S.C. 154(b) by 191 days.

(21) Appl. No.: 16/286,921

(22) Filed: Feb. 27, 2019

(65) Prior Publication Data

US 2019/0193257 A1 Jun. 27, 2019

Related U.S. Application Data

(60) Continuation-in-part of application No. 16/107,523, filed on Aug. 21, 2018, now Pat. No. 10,272,560, which is a division of application No. 14/961,200, filed on Dec. 7, 2015, now Pat. No. 10,052,753.

(51) Int. Cl.

| | |
|---|---|
| ***B25G 3/36*** | (2006.01) |
| ***B25G 3/30*** | (2006.01) |
| ***A47L 13/42*** | (2006.01) |
| *A47L 13/20* | (2006.01) |
| *B25G 1/10* | (2006.01) |
| *B21D 41/00* | (2006.01) |
| *A46B 5/00* | (2006.01) |
| *B25G 1/04* | (2006.01) |

(52) U.S. Cl.

CPC ..... *B25G 3/36* (2013.01); *B25G 3/30* (2013.01); *A46B 5/002* (2013.01); *A46B 2200/302* (2013.01); *A47L 13/20* (2013.01); *A47L 13/42* (2013.01); *B21D 41/00* (2013.01); *B25G 1/04* (2013.01); *B25G 1/10* (2013.01)

(58) Field of Classification Search

CPC .... B25G 3/36; B25G 3/30; B25G 1/04; A46B 5/002

USPC ..... 15/143.1, 144.3, 145

See application file for complete search history.

(56) References Cited

U.S. PATENT DOCUMENTS

| | | | | |
|---|---|---|---|---|
| 2,313,474 | A | 3/1943 | Hill | |
| 3,601,838 | A | 8/1971 | Marx | |
| 6,237,389 | B1 * | 5/2001 | Tada | B21D 17/02 72/367.1 |
| 6,902,060 | B2 * | 6/2005 | Michelson | A46B 15/0061 15/257.1 |
| 2008/0216262 | A1 | 9/2008 | Kennedy | |

FOREIGN PATENT DOCUMENTS

| | | | | |
|---|---|---|---|---|
| EP | 0347474 | A1 * | 12/1989 | B25G 1/04 |
| GB | 2371253 | | 4/2004 | |

* cited by examiner

*Primary Examiner* — Laura C Guidotti

(74) *Attorney, Agent, or Firm* — R. William Graham

(57) ABSTRACT

A multi-section quick assembly handle includes a multiple tubular members made of a permanently formable material having a threaded and friction fit connection.

14 Claims, 5 Drawing Sheets

MULTI-SECTION QUICK ASSEMBLY HANDLE AND METHOD OF MAKING SAME

This is a continuation-in-part of U.S. Ser. No. 16/107,523 filed Aug. 21, 2018 which is a divisional of U.S. Ser. No. 14/961,200 filed Dec. 7, 2015 now U.S. patent Ser. No. 10/052,753 and claims the benefit therefrom.

BACKGROUND OF INVENTION

Field of the Invention

The instant invention relates to handles for handle held implements, such as broom and mops and other cleaning tools and long handled tools. More particularly, the invention relates to a multi-section quick assembly handle and method of making same.

Related Art

There exist many elongated handles for use with mops, brooms and other hand held implements. Typically, these handles are generally cylindrical and have an end adapted with a connector such as a threaded end to be received in a complementary threaded female opening of the cleaning implement.

There also exist handles which thread together to extend the length the handles. These type of interconnecting handles tend to be relatively expensive as they are made from metal and plastic connector sections and are less fixably stable. The threaded sections tend to want to loosen as they are used. Multiple threaded sections increases this tendency to loosen.

There are also various forms of telescoping handles, where a smaller diameter tube fits inside a larger diameter tube, which limits the places an attachment can be added—such as a clip. The prior handles are also limited in their optional length as one one handle fits inside of the other. The telescoping handles have a means for setting the handles at a certain length. These handles are more expensive and almost always become loose over extended use.

Accordingly, there remains a need to provide a more economical, quickly assembled and substantially fixable interconnected handle. The invention meets the desired need to improve interconnected handles.

SUMMARY OF THE INVENTION

It is an object to improve handles for hand held implements.

It is another object to make a stronger multi-sectional handle.

Another object is to make a sectional handle without plastic interconnecting parts between the sections.

It is yet another object to improve multi-section quick assembly handle and method of making same.

It is still another object to improve a method of making multi-section quick assembly handle.

Yet another improvement is to provide a multi-section quick assembly handle which is postal friendly.

Yet another improvement is to provide a multi-section quick assembly handle which, once assembled, is close to being a conventional length handle.

Accordingly, the invention is directed to a multi-section quick assembly handle. The multi-section quick assembly handle includes a first tubular member made of a permanently formable material formed with a predetermined diameter (x) and an inner diameter (z) and having a first end and connecting to a second end of a smaller diameter (x−Δa), a transition section connecting the first end to the second end, and the second end having a threaded portion disposed a distance Δf from the transition section and a distance Δe from the terminal point of the second end; and a second tubular member made of a permanently formable material formed with a predetermined diameter (x) and an inner diameter (z) and having a first end and a second end, the second end having a threaded portion having a diameter (x+Δb') disposed a distance Δf' from a terminal point of the second end to complementary receive the threaded portion of the first tubular member by way of a threaded and friction fit to the second end of the first tubular member. At least one of the first ends having a connector for connecting a cleaning head, such as a mop or broom, to form a cleaning implement. Another embodiment employs intermediate tubular member (s) similarly formed for interconnection as described above.

A method of forming multi-section quick assembly handle provides a male forming tool having a male forming end having an opening with an entry inner diameter larger than the second outer diameter of the tubular members and an inwardly disposed inner diameter approximately that of the maximum outer diameter of the female forming tool and wherein the male forming end receives under pressure an end of the first tubular member it permanently forms an end of the first tubular member to have outer diameter formed complementary to be friction fit received into the female end said second tubular member. The formed male end and female end are of a minimal tolerance to cause the same to become substantially connected when threaded to each other. The method provides a thread forming tool (31) for forming a complementary thread on each of the end 16 and the end 22. The method further includes providing a cleaning head, such as a mop or broom, providing a cleaning head connector and connecting the same to one of the first ends to form a cleaning implement.

The assembled invention replaces the previously described handles providing for multiple fixed length handles, filling the same functions and using the same storage space. The present invention can only be put together one way, thus making it a one-way assembly.

The invention is postal friendly. For example, United Parcel Services charges a $9 surcharge for packages over 60" on length. Many current cleaning tools are 60" or longer. The invention eliminates this charge by fitting the handle into a much smaller box, without loss of function.

DETAILED DESCRIPTION OF PREFERRED EMBODIMENT

Figure 1:
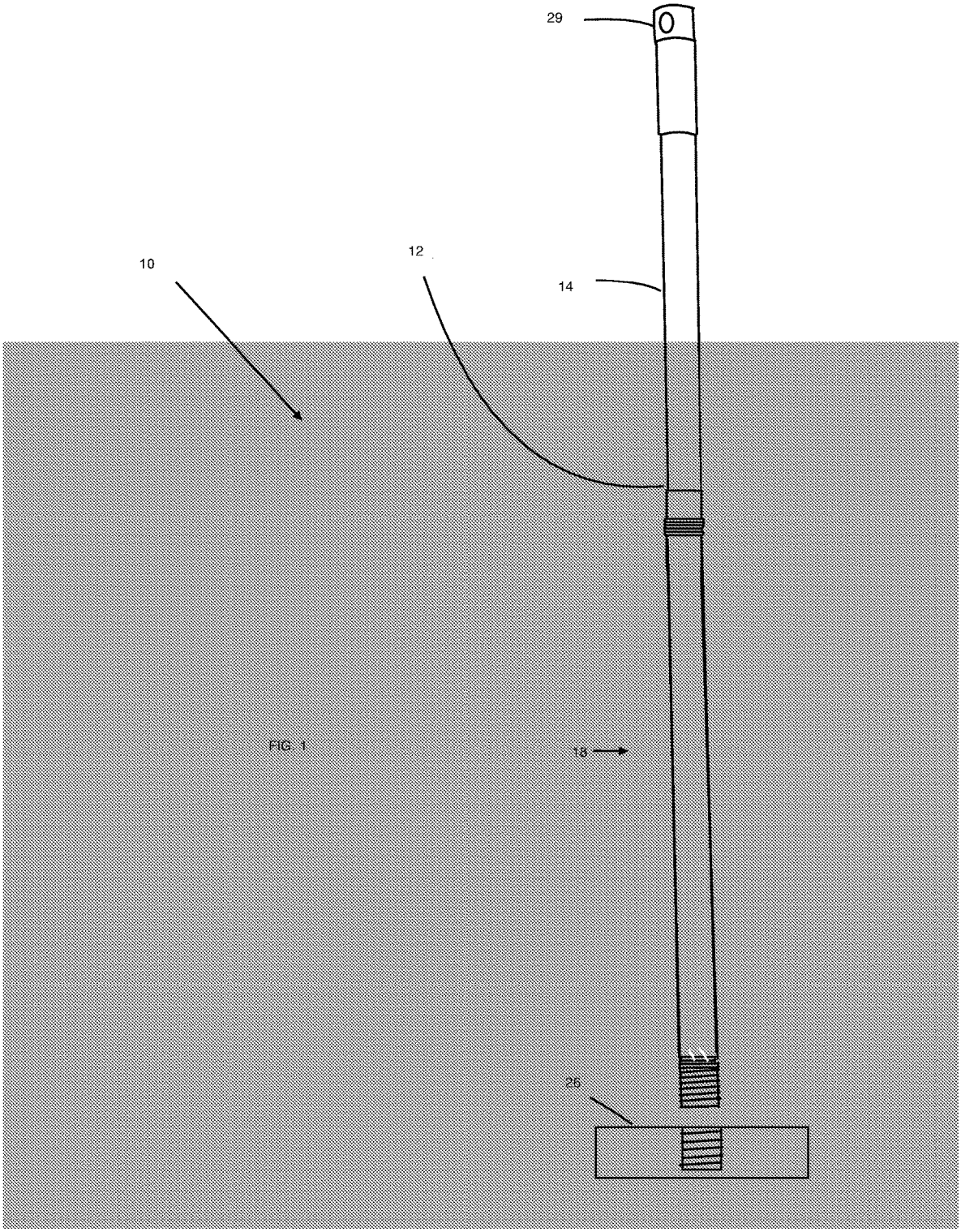
FIG. 1 shows the assembled sections of an embodiment of the invention.
Figure 2:
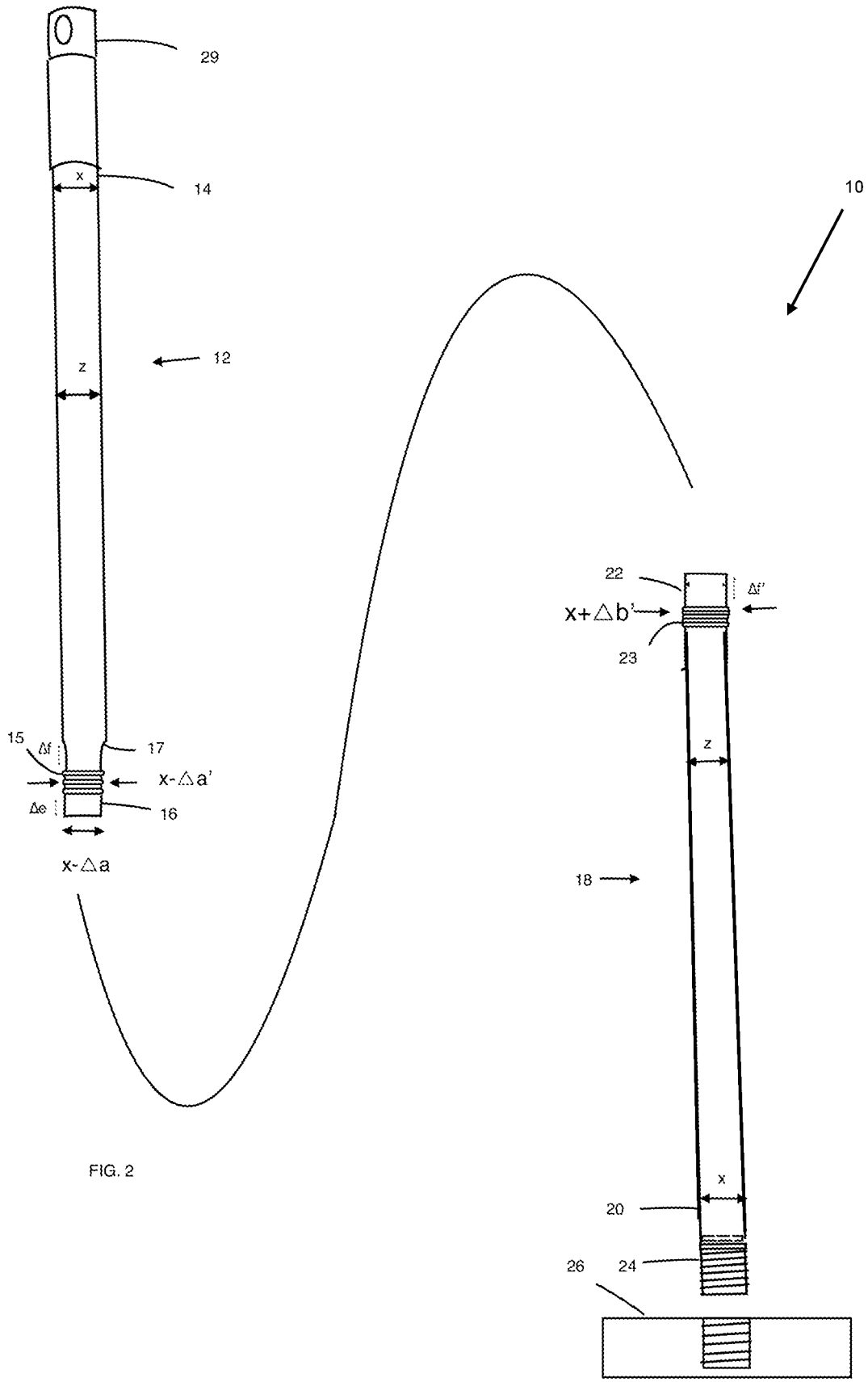
FIG. 2 is a side view drawing of sections of the invention prior to formation.
Figure 3:
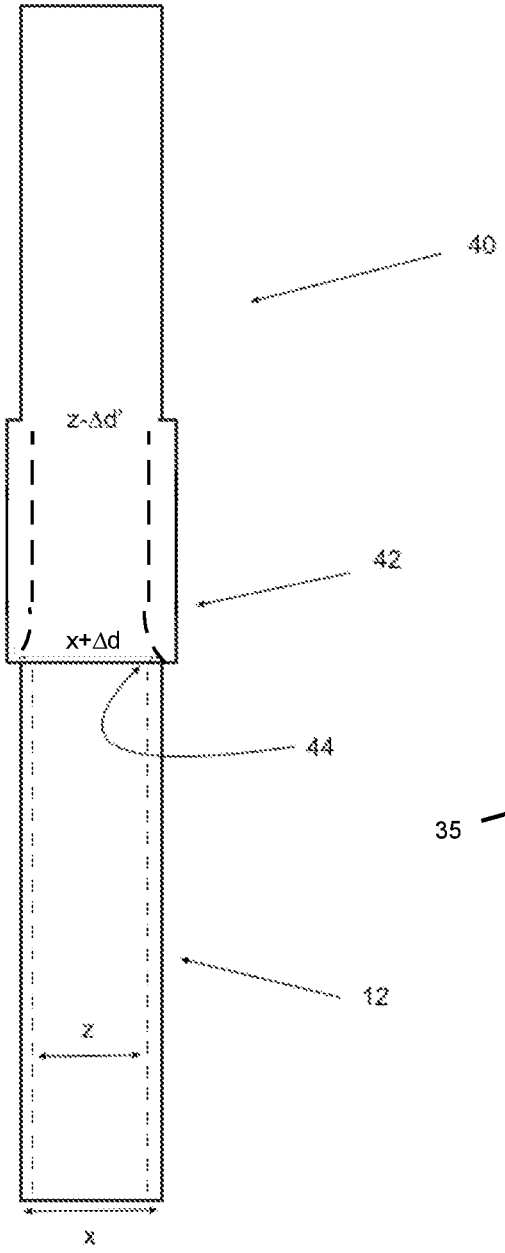
FIG. 3 shows a formation of a male section of the invention.
Figure 4:
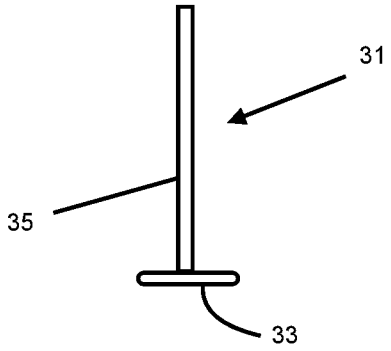
FIG. 4 shows an exemplary thread forming tool for forming a threaded portion of the invention.

Referring now to the drawings, the multi-section quick assembly handle of the instant invention is generally designated by the numeral 10. The multi-section quick assembly handle includes a first tubular member 12 made of a permanently formable material, such as aluminum or other extrudable metal material, for example. By "permanently formable" it is understood that the material can be subjected to forces which cause it to take on a new permanent shape. The member 12 has a first end 14 formed with a predetermined diameter (x) and connecting to a second end 16 forming a remaining portion of the first tubular member 12 which is a smaller diameter (x−Δa) and includes a threaded portion 15 which is a diameter (x−Δa') wherein the first end 14 connects to the second end 16 by way of a transition or tapered section 17. The threaded portion 15 is disposed a distance Δf from tapered section 17 and a distance Δe from the terminal point of second end 16.

There is also a second tubular member 18 made of a permanently formable material preferably similar to that described above and having a first end 20 with a predetermined diameter (x) substantially that of the first end 14 of the first tubular member 12 and connecting a second end 22 forming a remaining portion of the second tubular member 18. The second end 22 has a larger diameter (x) and an inner diameter (z) larger than diameter (x−Δa) and has a threaded portion 23 having a diameter (x+Δb') for threaded receipt of threaded portion 15. The threaded portion 23 is disposed a distance Δf' from the terminal point of second end 22. Thus on both sides of the threaded portion 23 there is a friction fit rendering a substantial, sure, sturdy and unique connection. In this regard, Δe and Δf portion of the end 16 do not include threaded portion 15, and Δe portion is inserted inwardly past threaded portion 23 of second end 22 and once threaded portion 15 is threaded to threaded portion 23, Δf portion and Δe portion of end 16 provide friction fit non-threaded cylindrical surface to non-threaded cylindrical surface on both side of connected threaded surfaces 15, 23. By so providing, strength and straightness of the combined members 12, 18, 50 through configuration of joining each sections together, makes for a finished handle which stronger and as straight as a one piece handle which is typically not attainable with prior techniques. The invention also allows for making of a very long handle which can include numerous sections, e.g., 10 for making a long handle, e.g, 8-10 ft, though able to be shipped to fit in a 12 inch box when in its dissembled form.

By way if example, the first end 20 has a connector 24 which can be a press fit threaded connector, for connecting a cleaning head 26, such as a mop or broom, to form a cleaning implement. The connector 24 does not necessarily require a thread, for example, in the case of a broom the connector 24 can have an end wound directly thereto or a piece of mop hardware could be riveted on thereto. Additionally, there can be provided an end cap 29 with an eyelet for connection to the other end 14 for permitting hanging and storage of the cleaning implement.

A method of forming multi-section quick assembly handle 10 is also provided. The method includes the steps of providing a first tubular member 12 and a second tubular member 18 of a first predetermined inner diameter (z) and a second predetermined outer diameter (x) wherein the tubular members 12, 18 and 50 are made of a permanently formable material, such as that previously described. The method includes providing a male forming tool 40 having a male forming end 42 having an opening 44 with an entry inner diameter (x+Δd) larger than the outer diameter (x) of the tubular members 12, 50, and 18 and tapers to an inwardly disposed inner diameter (z−Δd') which is slightly larger than (x−Δa). When the male forming end 42 receives under pressure end 16 of the tubular member 12 (or end 52 of tubular member 50) it permanently forms end 16 (or end 52) to have outer diameter (x−Δa) formed complementary to be friction fit received into one of the female end 22 or female end 54 end having inner diameter (z).

A secondary process includes the use of a thread forming rolling tool 31 which is inserted into the end 22 to form a threaded portion 23 post the initial formation. The tool 31 has a rolling head 33 and shaft 35 which can be adapted to a turning machine as is understood in the art. It is understood end 54 of intermediate tubular member 50 can be similarly formed.

It is understood end 52 of intermediate tubular member 50 can be similarly formed. The formed male end 16 and female end 22 are of a minimal tolerance to cause the same to become securely connected when threaded and fixed to each other. The method further includes providing cleaning head 26, such as a mop or broom, providing cleaning head connector 24 and connecting the same to end 14, for example, to form a cleaning implement.

By so providing, the instant invention, there is an advantage in that the tubular members 12, 50 and 18 enable the connection to become substantially threaded and fixed when they are put together. The interconnectable tubular members 12 and 18 members enable the shipment in a smaller box. The very popular Swiffer™ is an example of existing cleaning implement wherein the instant invention can provide an improved multi-piece handle that is easy to put together yet easily shipped.

Figure 5:
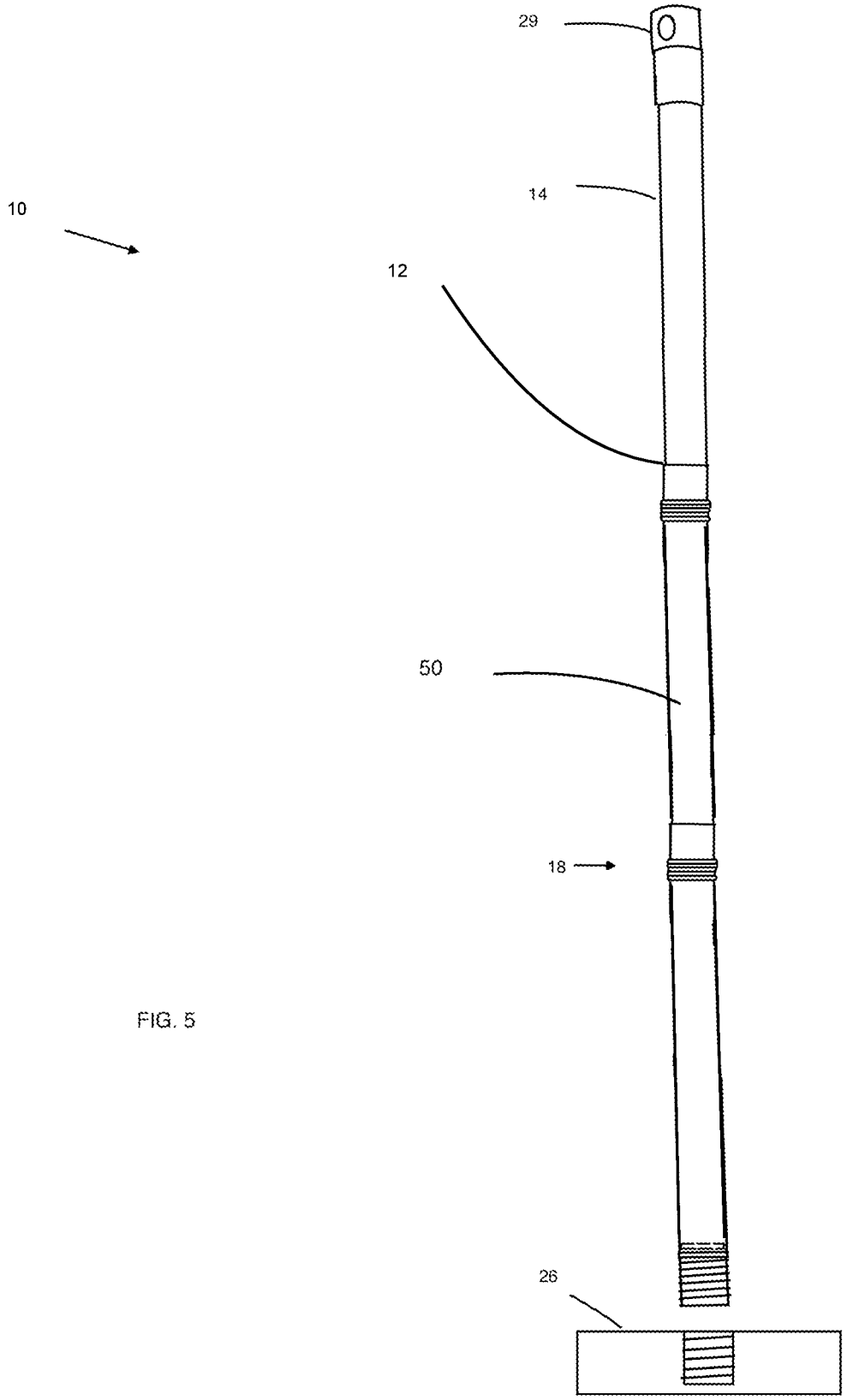
FIG. 5 depicts another embodiment of the invention.
Figure 6:
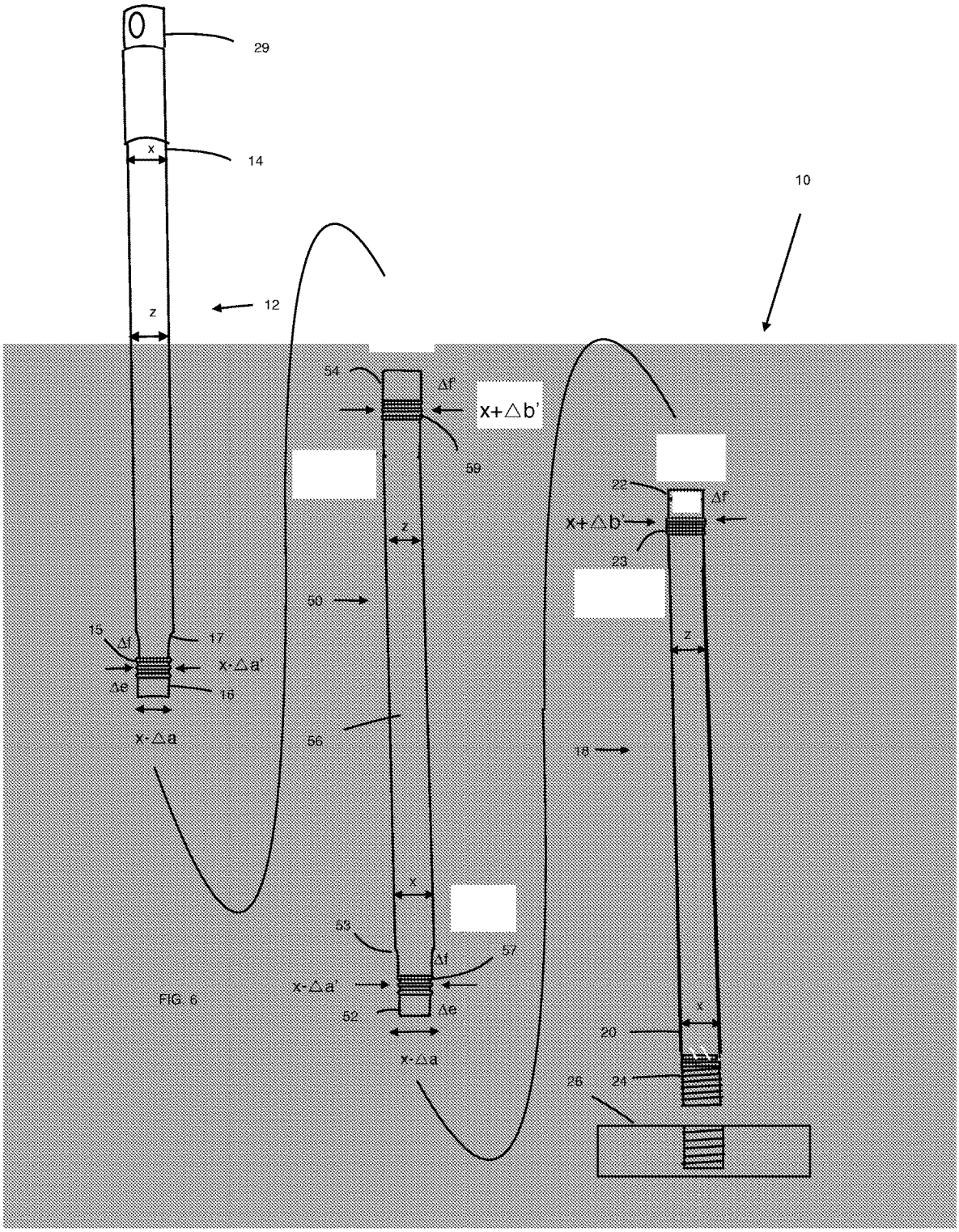
FIG. 6 is a side view drawing of sections of the invention prior to formation.

It is contemplated that there can be more than two tubular members, such as three, four or five members, in which case interconnecting set of ends can be similarly formed to that described above and as such the middle tubular member would have both ends modified to have any combination of male/female ends. FIG. 5 depicts intermediate tubular member 50 having a similarly formed smaller end 52 and end 54. The end 52 connects to an intermediate section 56 by way of a tapered section 53. End 52 includes a threaded portion 57 and end 54 includes a threaded portion 59. Thus, if a 60 inch handle is desired, it could be made of four 15 inch, three 20 inch or two 30 inch pieces to make a 60 inch which is the standard length for may cleaning tools. So, a 24 inch push broom could come with three 20 inch pieces in a compact 24 inch shipping box.

A use of the invention can be for lobby dust pans, where all handles are currently desirably 30 inch and prior hereto required a 30 inch long box. The dust pan may be only 15 inch and with the instant invention two pieces about 15 inch long can be employed so that the lobby dust pan and handle would fit nicely into a box which is about 15 inch long saving both box cost and shipping costs and storage space costs.

Other modifications, derivations and improvements will be readily apparent to those skilled in the art. For example, it is contemplated that one could mold handle sections in other ways or with other materials to provide the handle sections as disclosed. Accordingly, the appended claims hereto should be afforded the coverage of such modifications, derivations and improvements.

What is claimed is:

1. A multi-section quick assembly handle, which includes:

a first tubular member (12) made of a permanently formable material formed with a first predetermined diameter (x) having an inner diameter (z) and having a first end (14), a second end (16) having a second predetermined diameter (x−Δa), a transition section (17) connecting said first end (14) to said second end (16), and said second end (16) having a threaded portion (15) disposed a distance Δf from said transition section (17) defining a Δf portion of said second end (16) and said threaded portion (15) disposed a distance Δe from said terminal point of said second end (16) defining a Δe portion of said second end;

a second tubular member (18) made of a permanently formable material formed with a predetermined diameter (x) and an inner diameter (z) having a first end (20) and a second end (22), said second end (22) having a threaded portion (23) having a diameter (x+Δb') disposed a distance Δf' from a terminal point of said second end (22) defining a Δf' portion of said second end (22) to complementary receive said threaded portion (15) of said first tubular member (12) by way of a threaded and friction fit to said second end (16) of said first tubular member (12); and wherein said Δe portion of said second end (16) of said first tubular member (12) and said Δf portion of the second end (16) of said first tubular member (12) do not include threaded portion (15), and said Δe portion is inserted inwardly past threaded portion (23) of second end (22) of said second tubular member (18) and once threaded portion (15) of said first tubular member (12) is threaded to threaded portion (23) of said second tubular member (18), said Δf portion and said Δe portion of said second end (16) of said first tubular member (12) provide friction fit non-threaded surface to non-threaded surface connection on both sides of threaded surfaces (15, 23) of said first tubular member (12) and said second tubular member (18) respectively.

2. The multi-section quick assembly handle of claim 1, wherein said first end (14) of said first tubular member (12) connects to said second end (16) of said first tubular member (12) by way of a transition section (17).

3. The multi-section quick assembly handle of claim 1, wherein said first end (20) of said second tubular member (18) has a connector (24) for connecting a cleaning head (26).

4. The multi-section quick assembly handle of claim 3, which includes a cleaning head (26) connected to said connector (24) to form a cleaning implement.

5. The multi-section quick assembly handle of claim 1, wherein said tubular members are made from an extrudable metal material.

6. The multi-section quick assembly handle of claim 1, wherein said first end (14) of said first tubular member (12) has an end cap (29) with an eyelet connected thereto.

7. The multi-section quick assembly handle of claim 1, wherein said each tubular member is about two feet or less in length.

8. A multi-section quick assembly handle, which includes:

a first tubular member (12) made of a permanently formable material formed with a first predetermined diameter (x) and an inner diameter (z) and having a first end (14), a second end (16) having a second predetermined diameter (x−Δa), a transition section (17) connecting said first end (14) to said second end (16), and said second end (16) having a threaded portion (15) disposed a distance Δf from said transition section (17) defining a Δf portion of said second end (16) and said threaded portion (15) disposed a distance Δe from said terminal point of said second end (16) defining a Δe portion of said second end (16);

an intermediate tubular member (50) made of a permanently formable material formed with a first predetermined diameter (x) having inner diameter (z) and having a first end (52) of a second predetermined diameter (x−Δa) connecting an intermediate section (56) which in turn connects to a second end (54), said second end (54) having a threaded portion (59) disposed a distance Δf' from a terminal point of said second end (54) defining a Δf' portion of said second end to complementary receive threaded portion (15) of said first tubular member (12) by way of a threaded and friction fit said second end (54) of said intermediate tubular member (50), and said Δe portion of said first tubular member (12) is inserted inwardly past threaded portion (59) of second end (54) of said intermediate tubular member (50) and once threaded portion (15) of said first tubular member (12) is threaded to threaded portion (59) of said intermediate tubular member (50), said Δf' portion of said intermediate tubular member (50) and said Δe portion of end (16) of said first tubular member (12) provide friction fit non-threaded surface to non-threaded surface on both sides of said connected threaded surfaces (15, 59) of said first tubular member (12) and said intermediate tubular member (50) respectively; and a second tubular member (18) made of a permanently formable material formed with a predetermined diameter (x) having an inner diameter (z) and having a first end (20) and a second end (22), said second end (22) having a threaded portion (23) disposed a distance Δf' from a terminal point of said second end (22) defining a Δf' portion of said second end (22), said threaded portion (23) said second tubular member (18) to complementary receive threaded portion (57) of said intermediate tubular member (50) by way of a threaded and friction fit said second end (52) of said intermediate tubular member (50) and a Δe portion of said first end (52) and a Δf portion of the end (52) do not include threaded portion (57) of said intermediate tubular member (50), and said Δe portion of said end (52) is inserted inwardly past threaded portion (23) of second end (22) of said second tubular member (18) and once threaded portion (58) of said intermediate tubular member (50) is threaded to threaded portion (23) of said second tubular member (18), Δf portion and Δe portion of said first end (52) of said intermediate tubular member (50) provide friction fit non-threaded surface to non-threaded surface on both sides of connected threaded surfaces (57, 23) of said intermediate tubular member (50) and said second tubular member (18) respectively.

9. The multi-section quick assembly handle of claim 8, wherein said tubular members include transition sections between each said first end and said second end are tapered.

10. The multi-section quick assembly handle of claim 8, wherein said first end (20) of said second tubular member has a connector (24) for connecting a cleaning head (26).

11. The multi-section quick assembly handle of claim 10, which includes a cleaning head (26) to form a cleaning implement.

12. The multi-section quick assembly handle of claim 8, wherein said tubular members are made from an extrudable metal material.

13. The multi-section quick assembly handle of claim 8, wherein said first end (14) of said first tubular member has an end cap (29) with an eyelet connected thereto.

14. The multi-section quick assembly handle of claim 8, wherein said each tubular member is about two feet or less in length.

* * * * *